US007597220B2

(12) United States Patent
Lim

(10) Patent No.: US 7,597,220 B2
(45) Date of Patent: Oct. 6, 2009

(54) COUPLER FOR DISCHARGING CHEMICALS

(75) Inventor: Jang-Wook Lim, Gunpo-si (KR)

(73) Assignee: Aicello Milim Chemical Co., Ltd., Siheung-Si, Gyeonggi-Do (KR)

( * ) Notice: Subject to any disclaimer, the term of this patent is extended or adjusted under 35 U.S.C. 154(b) by 429 days.

(21) Appl. No.: 11/688,797

(22) Filed: Mar. 20, 2007

(65) Prior Publication Data

US 2008/0023496 A1 Jan. 31, 2008

(30) Foreign Application Priority Data

Mar. 29, 2006 (KR) ..... 20-2006-0008374 U

(51) Int. Cl.
*B65D 83/00* (2006.01)

(52) U.S. Cl. ..... 222/400.7; 137/212

(58) Field of Classification Search ..... 222/400.5, 222/400.7, 400.8; 137/212
See application file for complete search history.

(56) References Cited

U.S. PATENT DOCUMENTS 3,591,058 A * 7/1971 Johnston ..... 222/400.7
3,610,478 A * 10/1971 Johnston ..... 222/400.7
5,957,328 A * 9/1999 Osgar ..... 222/400.7
2008/0011785 A1* 1/2008 Braun et al. ..... 222/400.7

* cited by examiner

*Primary Examiner*—Kevin P Shaver
*Assistant Examiner*—Jonathan Wood
(74) *Attorney, Agent, or Firm*—IPLA P.A.; James E. Bame

(57) ABSTRACT

Disclosed herein is a coupler, which is used for discharging a chemical outside a container and includes an internal coupler unit and an external coupler unit. The internal coupler unit includes a mounting part and a coupling pipe. The external coupler unit includes a main housing. Coupling seats are formed in respective opposite ends of the main housing, and a side hole is formed in the main housing. The external coupler unit further includes a hollow rod member, and a hollow cylindrical member. The external coupler unit further includes a subsidiary housing fitted over the hollow cylindrical member, a fluid opening control unit, a pumping means connector, a gas injection means connector tightened into the side hole of the main housing, and sealing caps, which close respective openings of the pumping means connector and the gas injection means connector when not in use.

6 Claims, 6 Drawing Sheets

COUPLER FOR DISCHARGING CHEMICALS

CROSS REFERENCE

Applicant claims foreign priority under Paris Convention and 35 U.S.C. § 119 to the Korean Patent Application No. 20-2006-0008374, filed Mar. 29, 2006 with the Korean Intellectual Property Office.

BACKGROUND OF THE INVENTION

1. Field of the Invention

The present invention relates generally to couplers used for discharging highly pure chemicals, stored in containers, to the outside and, more particularly, to a coupler for discharging chemicals which makes it possible to discharge a chemical outside a container using only a single opening (a chemical outlet port) formed in the container and, simultaneously, makes it possible to inject gas into the container to facilitate the discharge of the chemical from the container and to maintain the superior purity and cleanliness of the chemical, and which has a faulty coupling prevention function, thus fundamentally preventing faulty use of the chemical.

2. Description of the Related Art

As well known to those skilled in the art, chemicals, such as chemicals pertaining to semiconductors or medical supplies, chemicals for the electronics industry, reagent chemicals, chemicals for food or cosmetics, etc., are stored in containers. When it is desired to use a chemical, an appropriate amount of the chemical is discharged from such a container.

Typically, a container for a chemical has a chemical outlet port, through which the chemical is discharged outside the container, and an air inlet port, through which air for maintaining the pressure in the container at atmospheric pressure is drawn into the container to facilitate discharge of the chemical from the container. In addition, the container is provided with caps for operably closing the chemical outlet port and the air inlet port.

Therefore, when it is desired to use the chemical contained in the container, the caps are removed from the container to open the chemical outlet port and the air inlet port and, thereafter, the chemical is discharged outside the container through the chemical outlet port.

Here, in the case of chemicals, such as chemicals pertaining to semiconductors or medical supplies, the chemicals must be prevented from contacting air to eliminate the possibility of contamination, such that the high purity and cleanliness of the chemical can be maintained while it is stored in the container and even when it is discharged outside the container. However, the conventional technique is problematic in that it is difficult to achieve the above-mentioned purpose when the chemical is discharged outside the container.

Furthermore, the chemical must be discharged to a desired place, but the conventional technique has a problem in that there is a likelihood of faulty discharge and application of the chemical, attributable to a mistake made by a worker.

SUMMARY OF THE INVENTION

Accordingly, the present invention has been made keeping in mind the above problems occurring in the prior art, and an object of the present invention is to provide a coupler for discharging chemicals, in which a discharge passage for discharging a chemical outside a container and a gas injection passage for maintaining the pressure in the container the same as atmospheric pressure are formed in a single body, so that, although only a single opening (a chemical outlet port) is formed in the container, the chemical, which has been contained in the container, can be easily discharged outside the container through the opening, and, simultaneously, an operation of injecting gas into the container for facilitating the discharge of the chemical from the container and for maintaining the superior purity of the chemical can be easily conducted, and which can prevent the chemical from contacting outside air when the chemical is discharged outside the container, thus maintaining the superior purity and cleanliness of the chemical in the container, and which does not require the formation of a separate air inlet in the container, unlike the conventional art, in which a separate air inlet has been required to be formed in the container.

Another object of the present invention is to provide a coupler for discharging chemicals which can effectively prevent faulty discharge and application of the chemical, attributable to a mistake made by a worker.

In order to accomplish the above objects, the present invention provides a coupler for discharging a chemical outside a container, through an internal coupler unit coupled to a chemical outlet port of the container and then through an external coupler unit coupled to the internal coupler unit, wherein the external coupler unit includes a main housing comprising a cylindrical body having a hollow space therein, with upper and lower coupling seats respectively formed in upper and lower ends of the main housing and having respective internal threads therein, and a side hole formed through a sidewall of the main housing and communicating with the hollow space of the main housing; a hollow rod member inserted into the hollow space of the main housing and having a structure such that a lower end of the hollow rod member protrudes from a lower end of the main housing and an upper end of the hollow rod member engages with the upper coupling seat of the main housing, with an internal thread formed on a circumferential inner surface of the upper end of the hollow rod member; a hollow cylindrical member having on a circumferential outer surface of an upper end thereof an external thread to be tightened into the lower coupling seat of the main housing, with a stopper protruding outwards from a lower end of the hollow cylindrical member; a subsidiary housing fitted over the hollow cylindrical member and stopped by the stopper of the hollow cylindrical member, with an external thread formed on a circumferential outer surface of a lower end of the subsidiary housing to couple the subsidiary housing to the internal coupler unit; a fluid opening control unit provided in the lower end of the hollow rod member and having a spring and a valve, which are coupled to each other and are respectively supported at upper and lower predetermined positions in the lower end of the hollow rod member; a pumping means connector coupled to the upper end of the hollow rod member to connect the external coupler unit to a pumping means for pumping the chemical outside the container; a gas injection means connector tightened into the side hole of the main housing to connect the external coupler unit to a gas injection means for injecting gas into the container; and a plurality of sealing caps to close respective openings of the pumping means connector and the gas injection means connector when the pumping means connector and the gas injection means connector are not in use.

Furthermore, the internal coupler unit may include: a mounting part, having an external thread for coupling the internal coupler unit to the chemical outlet port of the container, and an internal thread for coupling the internal coupler unit to the external coupler unit; and a coupling pipe communicating with the mounting part and extending downwards from the mounting part, the coupling pipe being dipped into the chemical in the container when the internal coupler unit is coupled to the container, wherein a compressing protrusion is provided on a central portion of the mounting part and communicates with the coupling pipe, and a gas injection hole is formed through a bottom of the mounting part.

Preferably, a linear cross-sectional part may be longitudinally formed on a circumferential outer surface of the hollow rod member to facilitate injection of gas into the container.

In addition, the external coupler unit may further include a faulty coupling prevention member, which is fitted over the circumferential outer surface of the subsidiary housing and has a plurality of faulty coupling prevention protrusions under a lower surface thereof, and a plurality of faulty coupling prevention holes may be formed in a perimeter of an upper surface of the mounting part of the internal coupler unit, thus preventing faulty coupling of the external coupler unit to the internal coupler unit.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a preferred embodiment of the present invention will be described in detail with reference to the attached drawings.

Figure 1:
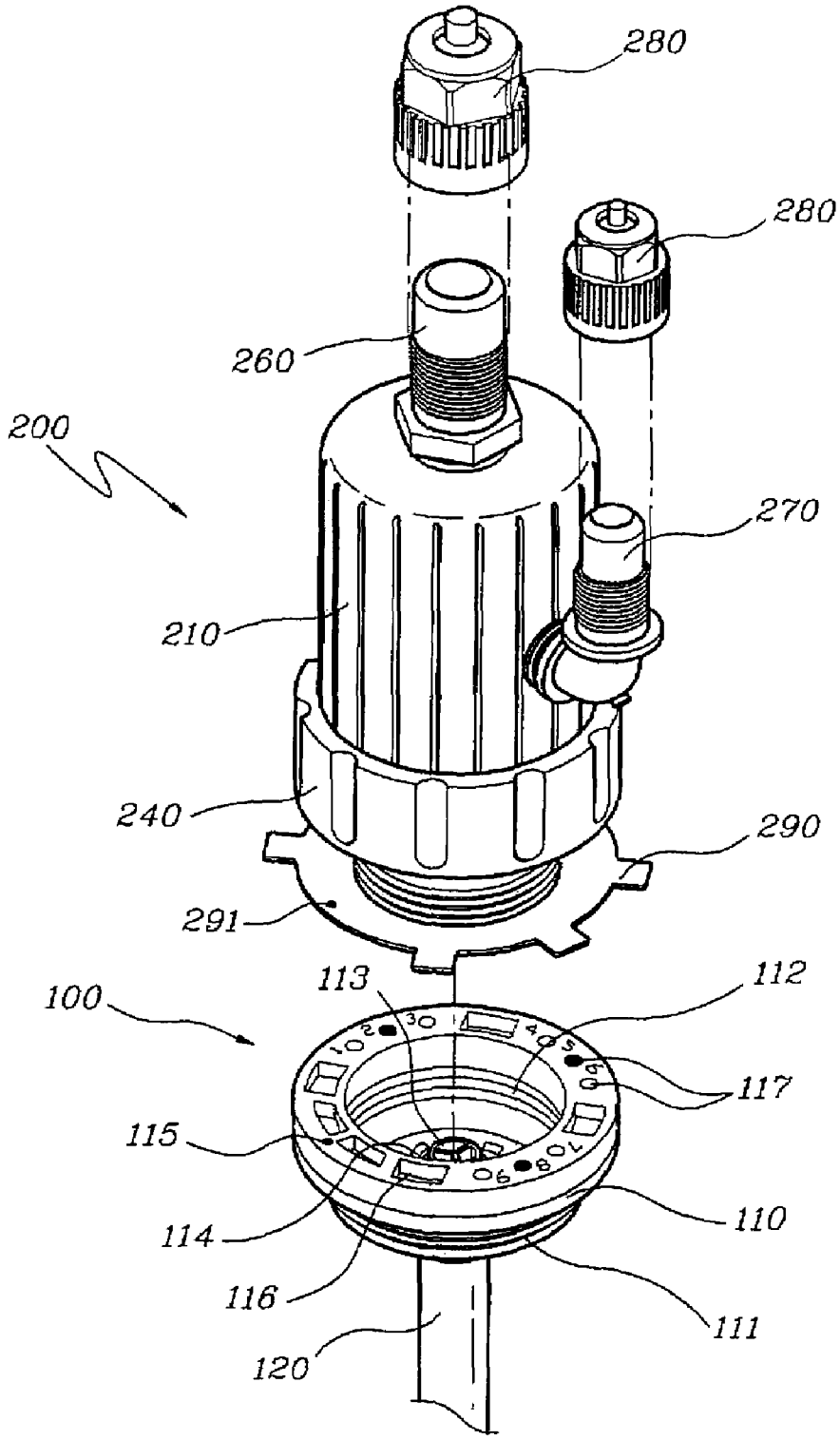
FIG. 1 is an exploded perspective view illustrating a coupler for discharging a chemical, according to an embodiment of the present invention.
Figure 2:
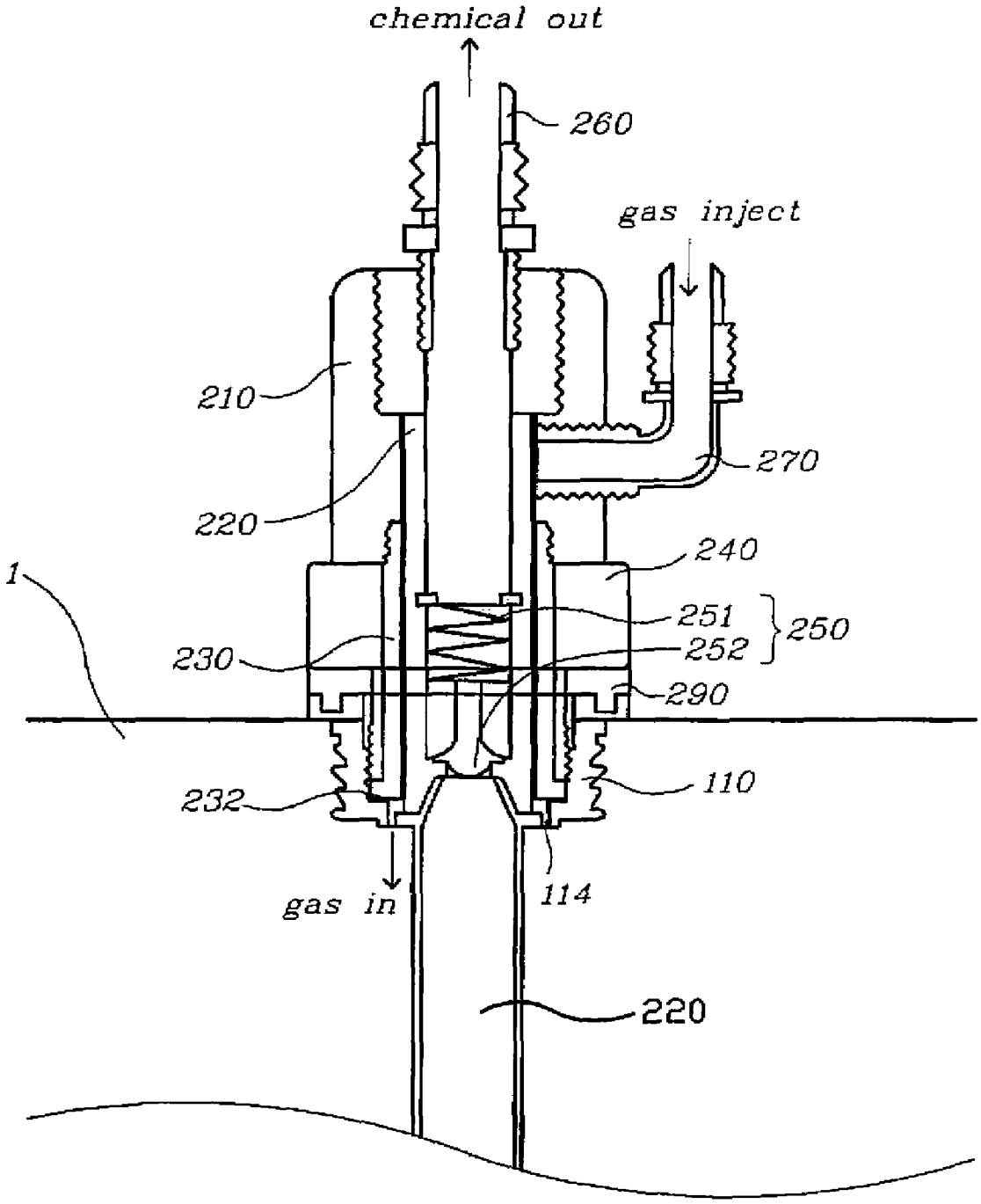
FIG. 2 is a sectional view illustrating an assembled state of the coupler according to the present invention.
Figure 3:
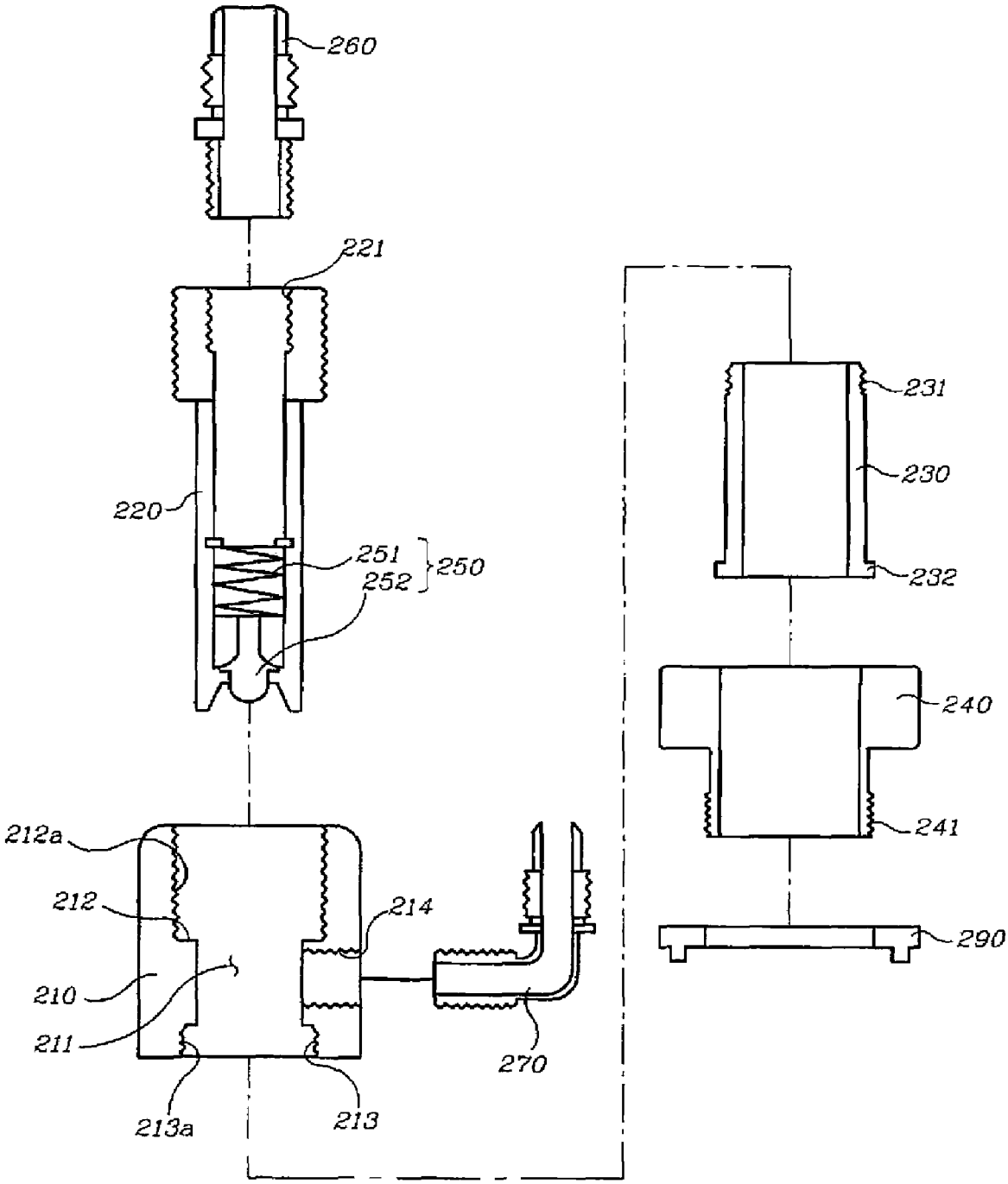
FIG. 3 is an exploded sectional view of an external coupler unit of the coupler according to the present invention.
Figure 4:
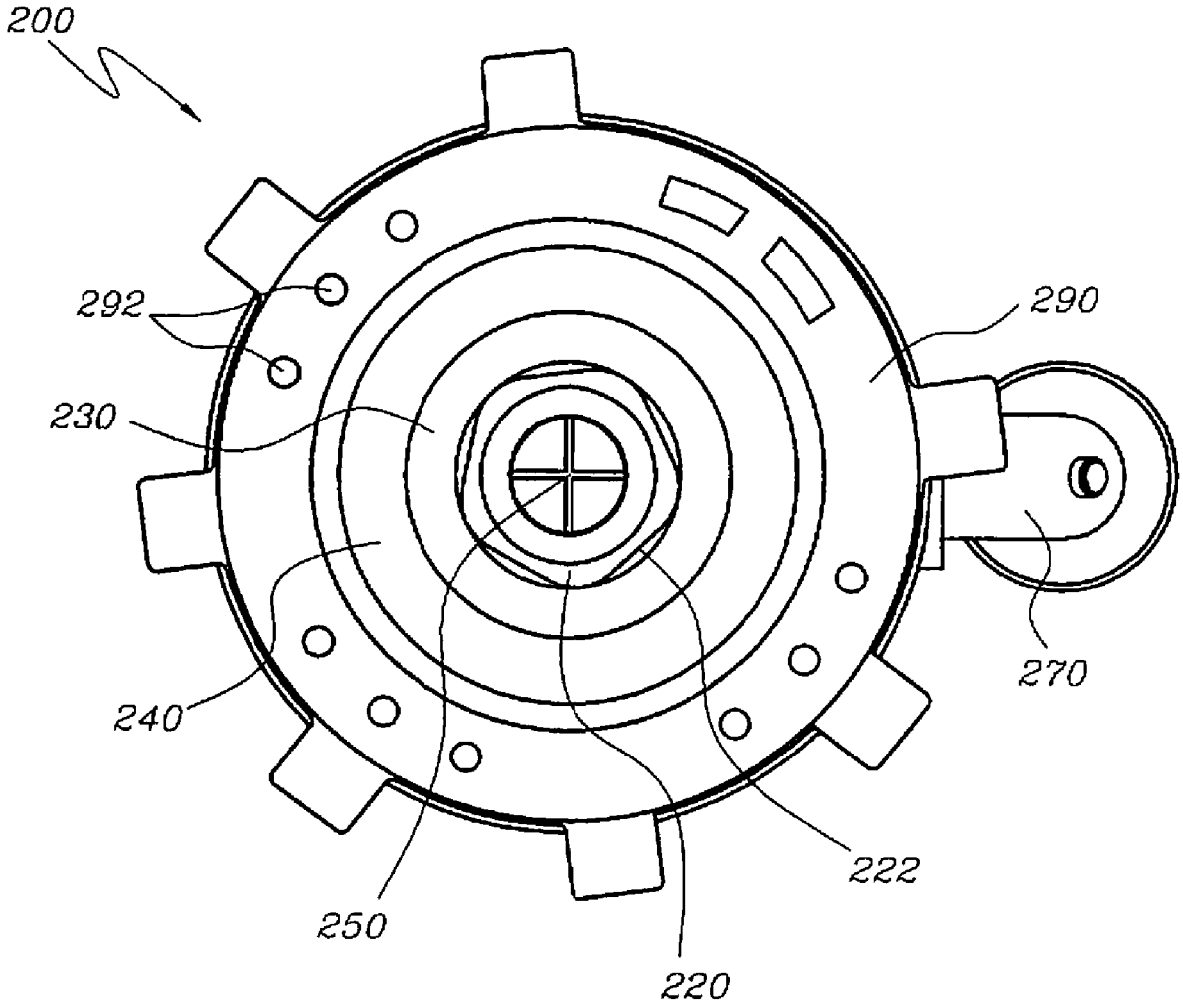
FIG. 4 is a bottom view illustrating the assembled external coupler unit of the coupler according to the present invention.
Figure 5:
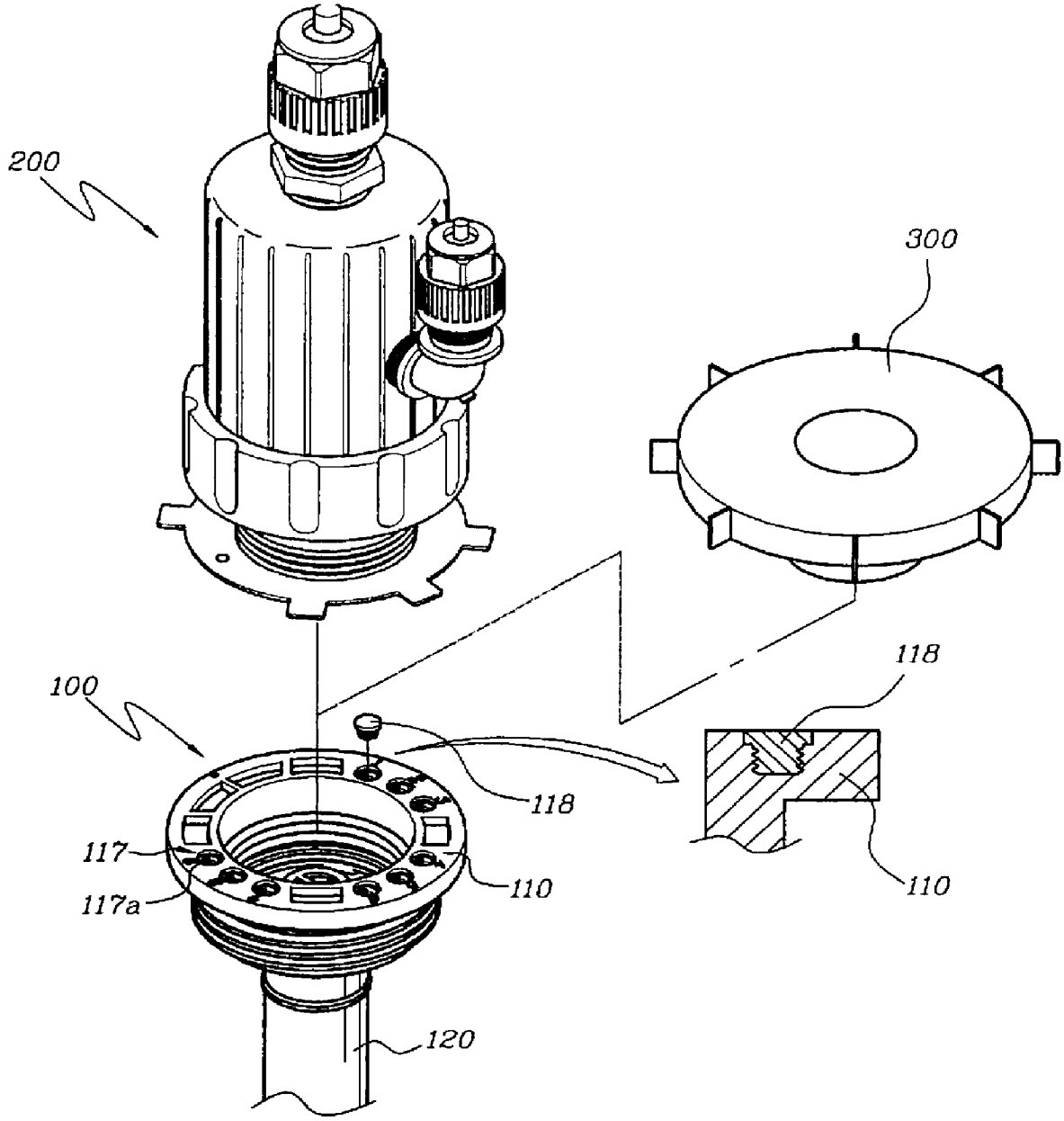
FIG. 5 is a view showing another embodiment for preventing faulty coupling of the coupler according to the present invention.
Figure 6:
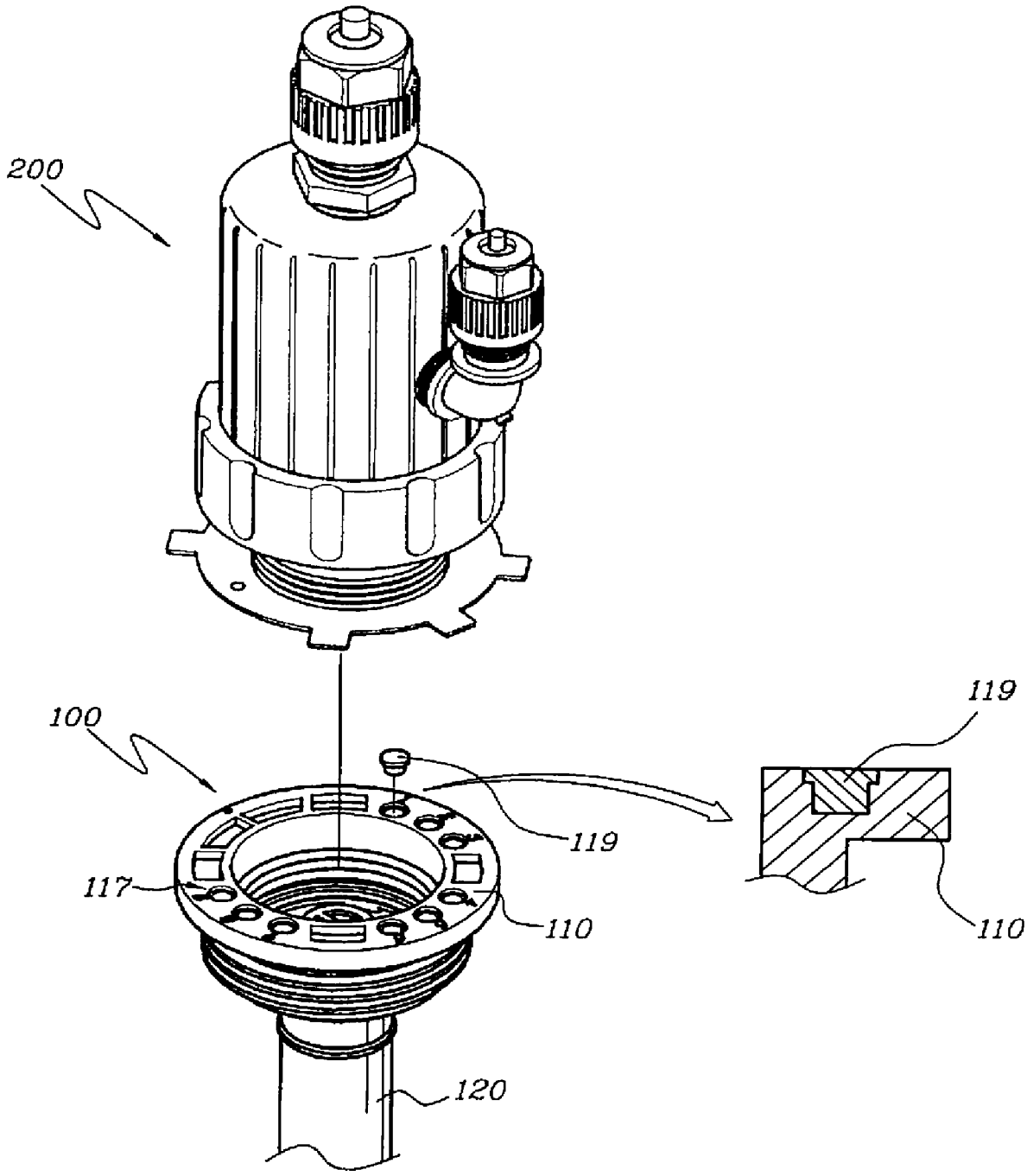
FIG. 6 is a view showing a further embodiment for preventing faulty coupling of the coupler according to the present invention.

FIG. 1 is an exploded perspective view illustrating a coupler for discharging a chemical, according to an embodiment of the present invention. FIG. 2 is a sectional view illustrating the assembled state of the coupler according to the present invention. FIG. 3 is an exploded sectional view of an external coupler unit of the coupler according to the present invention. FIG. 4 is a bottom view illustrating the assembled external coupler unit of the coupler according to the present invention. FIG. 5 is a view showing another embodiment for preventing faulty coupling of the coupler according to the present invention. FIG. 6 is a view showing a further embodiment for preventing faulty coupling of the coupler according to the present invention.

As shown in FIGS. 1 through 4, the coupler for discharging a chemical according to the embodiment of the present invention does not require the formation of a separate air inlet in a container. The coupler according to the embodiment of the present invention includes an internal coupler unit 100, which is coupled to a chemical outlet port of the container 1 and opens a fluid flow passage of an external coupler unit 200 when the external coupler unit 200 is coupled to the internal coupler unit 100, and the external coupler unit 200, which is coupled to the internal coupler unit 100 and is connected to a pumping means and a gas injection means (not shown) for discharging the chemical from the container, so that the chemical, which has been in the container 1, is discharged outside through only one opening of the chemical outlet port and, simultaneously, gas is injected into the container 1.

The internal coupler unit 100 includes a mounting part 110, which has an external thread 111 for coupling the internal coupler unit 100 to the chemical outlet port of the container and an internal thread 112 for coupling the internal coupler unit 100 to the external coupler unit 200, and a coupling pipe 120, which communicates with and extends downwards from the mounting part 110 and is dipped into the chemical in the container 1 when the internal coupler unit 100 is coupled to the container 1.

Here, a compressing protrusion 113, which communicates with the coupling pipe 120 and protrudes upwards, is provided in a central portion of the mounting part 110. A gas injection hole 114, through which gas is injected from the external coupler unit 200 into the container 1, is formed through the bottom of the mounting part 110.

Furthermore, a coupling reference point 115, which serves as an indication point when the external coupler unit 200 is coupled to the internal coupler unit 100, is provided on the upper surface of the mounting part 110. Several coupling compressing depressions 116 for facilitating the application of torque for tightening the internal coupler unit 100 to the container 1, and several faulty coupling prevention holes 117, which are denoted by numerals, are formed in the upper surface of the mounting part 110.

In detail, a separate coupling jig (not shown) engages with the coupling compressing depressions 116 and provides tightening torque to the internal coupler unit 100, so that the internal coupler unit can be coupled to the container 1 more reliably. The faulty coupling prevention holes 117 are formed to have a structure such that some holes maintain their closed states without opening, depending on the numbers (key code numbers) marked on the upper surface of the mounting part 110, that is, depending on the kind of chemical contained in the container 1, thus preventing faulty coupling of the coupler.

Meanwhile, as shown in FIGS. 5 and 6, the internal coupler unit 100 may be constructed such that all faulty coupling prevention holes 117 are formed in the open states and, as necessary, some of the faulty coupling prevention holes 117 are selectively closed.

In detail, FIG. 5 shows an example, which has a structure such that an internal thread 117*a* is formed in the inner surface of each faulty coupling prevention hole 117, and such that an adjustment bolt 118 is selectively screwed into the faulty coupling prevention hole 117. FIG. 6 shows another example, which is constructed such that an insert member 119 is selectively fitted into the faulty coupling prevention holes 117.

The external coupler unit 200 includes a main housing 210, which comprises a cylindrical body having a hollow space 211 therein. Coupling seats 212 and 213, which have respective internal threads 212*a* and 213*a*, are respectively formed in upper and lower ends of the main housing 210. In addition, a side hole 214, which communicates with the hollow space 211 of the main housing 210, is formed through a sidewall of the main housing 210. The external coupler unit 200 further includes a hollow rod member 220, which is inserted into the hollow space 211 of the main housing 210 to have a structure such that a lower end of the hollow rod member 220 protrudes from a lower end of the main housing 210, and an upper end of the hollow rod member 220 engages with the upper coupling seat 212 of the main housing 210. As well, an internal thread 221 is formed on the circumferential inner surface of the upper end of the hollow rod member 220. The external coupler unit 200 further includes a hollow cylindrical member 230, which has on the circumferential outer surface thereof an external thread 231, which is tightened into the lower coupling seat 213 of the main housing 210, and has a stopper 232 that protrudes outwards from the lower end of the cylindrical member 231. The external coupler unit 200 further includes a subsidiary housing 240, which is fitted over the cylindrical member 230 and is stopped by the stopper 232 of the cylindrical member 230, and has on a lower end thereof an external thread 241 that is tightened into the mounting part 110 of the internal coupler unit 100. The external coupler unit 200 further includes a fluid opening control unit 250, which is provided in the lower end of the hollow rod member 220 and has a spring 251 and a valve 252, which are coupled to each other and are respectively supported at upper and lower predetermined positions in the hollow rod member 220. The external coupler unit 200 further includes a pumping means connector 260, which is coupled to the upper end of the hollow rod member 220 to connect the external coupler unit 200 to the pumping means (not shown) for pumping the chemical from the container 1 to the outside, a gas injection means connector 270, which is coupled to the side hole 214 of the main housing 210 and couples the external coupler unit 200 to the gas injection means (not shown) for injecting gas into the container, and sealing caps 280, which close openings of the pumping means connector 260 and the gas injection means connector 270 when they are not in use.

Furthermore, the external coupler unit 200 further includes a faulty coupling prevention member 290, which is fitted over the circumferential outer surface of the subsidiary housing 240 and serves to prevent the external coupler unit 200 from being incorrectly coupled to the internal coupler unit 100.

In addition, a coupling reference point 291 corresponding to the coupling reference point 115 of the mounting part 110 of the internal coupler unit 100 is provided on the ripper surface of the faulty coupling prevention member 290, and faulty coupling prevention protrusions 292 are provided under the lower surface of the faulty coupling prevention member 290 at positions corresponding to the faulty coupling prevention holes 117.

Preferably, as shown in FIG. 4, linear cross-sectional parts 222, each of which has a linear cross-section, are longitudinally formed on the circumferential outer surface of the hollow rod member 220. The linear cross-sectional parts 222 form gaps between the hollow rod member 220 and the main housing 210 and the subsidiary housing 240, which internally engage with the hollow rod member 220, thus defining a gas injection passage such that gas drawn into the side hole 214 of the main housing 210 can be easily injected into the container 1 through the gas injection passage.

The operation and effect of the coupler of the present invention having the above-mentioned construction will be explained herein below.

The coupling pipe 120 of the internal coupler unit 100 is inserted into the chemical outlet port of the container 1 and is dipped into the chemical contained in the container 1.

Thereafter, the mounting part 110 of the internal coupler unit 100 is tightened into the chemical outlet port of the container 1 such that the internal coupler unit 100 is reliably fastened to the container 1. At this time, the internal coupler unit 100 can be more reliably fastened to the container 1 by providing tightening torque through the coupling compression depressions 116 using the coupling jig (not shown).

Subsequently, in a state in which the external coupler unit 200 is placed on the internal coupler unit 100, whether the external coupler unit 200 and the internal coupler unit 100 match each other and thus form a correct pair is confirmed using the faulty coupling prevention member 290 of the external coupler unit 200. Thereafter, the subsidiary housing 240 is tightened into the mounting part 110 of the internal coupler unit 100, and thus the external coupler unit 200 is securely coupled to the internal coupler unit 100.

Here, the present invention is constructed such that, after the confirmation of whether the faulty coupling prevention protrusions 292 match the faulty coupling prevention holes 117 using the coupling reference points 115 and 291, if they do not match, a worker checks whether the chemical in the container 1 is the desired chemical. As such, the present invention can prevent the unintentional use of a chemical, attributable to worker error.

For example, when a chemical is used for the first time, if the external coupler unit 200 does not match the internal coupler unit 100, after checking the chemical, some of the coupling prevention protrusions 292 of the external coupler unit 200 may be removed such that they match the faulty coupling prevention holes 117 of the internal coupler unit 100 or, alternatively, another external coupler unit 200, which has been used and has faulty coupling prevention members 290 corresponding to the faulty coupling prevention holes 117, that is, corresponding to the chemical, may be used. The reason for this is to provide tightening force corresponding to the stored chemical to the coupler.

When the external coupler unit 200 is coupled to the internal coupler unit 100, the compression protrusion 113 of the internal coupler unit 100 pushes upwards the valve 252 of the fluid opening control unit 250, which is disposed in the lower end of the hollow rod member 200, thus opening the fluid flow passage, through which the chemical is discharged outside. Thereafter, the sealing caps 280 are removed, the pumping means (not shown) is connected to the pumping means connector 260, and the gas injection means (not shown) is connected to the gas injection means connector 270.

When the pumping means is operated, the chemical is discharged from the container 1 into the hollow space of the hollow rod member 220, which is in the open state, through the coupling pipe 120 and, thereafter, is discharged outside through the pumping means connector 260. Simultaneously, gas such as nitrogen is drawn into the mounting part 110 of the internal coupler unit 100 along the outer surface of the hollow rod member 220 via the side hole 214 of the main housing 210 and, thereafter, is drawn into the container 1 through the gas injection hole 114, which is formed through the bottom of the mounting part 110. Here, because the linear cross-sectional parts 222 are formed on the outer surface of the hollow rod member 220, the gas injection passage can be enlarged, thus making it easy to inject gas into the container 1.

The injection of gas, which is conducted at the same time that the chemical is discharged, serves to maintain the pressure in the container 1 at the outside atmospheric pressure, thus making it easy to discharge the chemical outside the container 1. Furthermore, the gas, which is injected into the container 1, serves to gas-process and prevents the chemical in the container 1 from contacting outside air, thus maintaining the high degree of purity and cleanliness of the chemical.

As such, the coupler for discharging the chemical according to the present invention can be used, even though the container 1 has only one opening, and the superior purity and cleanliness of the chemical can be maintained even after the use of the chemical has begun. Furthermore, the coupler of the present invention can effectively prevent the chemical from contacting outside air and from being contaminated by foreign substances. In addition, because the coupler of the present invention makes it possible to inject gas into the container 1 while the chemical is discharged outside the container 1, the discharge of the chemical can be smoothly conducted.

Furthermore, the coupler of the present invention has the faulty coupling prevention means including the internal coupler unit 100 and the external coupler unit 200, thus preventing faulty coupling attributable to worker error, thereby fundamentally preventing faulty use of the chemical in the container.

Moreover, the coupler of the present invention may be used to discharge typical fluid, other than chemicals, and, as well, may be used to inject an additive into the fluid.

Meanwhile, as shown in FIG. 5, when the coupler of the present invention is used to discharge a chemical, the external coupler unit 200 is coupled to the internal coupler unit 100, and, when the coupler of the present invention is not in use, the internal coupler unit 100 may be covered with a separate cover 300.

Although the preferred embodiments of the coupler for discharging chemicals according to the present invention have been disclosed for illustrative purposes with reference to the attached drawings, the present invention is not limited to these. Those skilled in the art will appreciate that various modifications, additions and substitutions are possible, without departing from the scope and spirit of the invention as disclosed in the accompanying claims.

As described above, the present invention provides a coupler for discharging chemicals in which a discharge passage for discharging a chemical outside a container and a gas injection passage for maintaining the pressure in the container at the same pressure as the atmospheric pressure are formed in a single body, so that, although only a single opening (a chemical outlet port) is formed in the container, the chemical, which has been contained in the container, can be easily discharged outside the container through the opening, and, simultaneously, an operation of injecting gas into the container for facilitating the discharge of the chemical from the container and for maintaining superior purity of the chemical can be easily conducted.

Therefore, the present invention facilitates the discharge of the chemical from the container and can prevent the chemical from contacting outside air, thus maintaining the superior purity and cleanliness of the chemical in the container. Furthermore, there is an advantage in that a process of forming a separate air inlet in the container is not required, unlike the conventional art, which required a separate air inlet to be formed in the container.

Moreover, because the present invention has a structure that prevents faulty coupling of an external coupler unit to an internal coupler unit, faulty coupling of the coupler attributable to worker error can be fundamentally prevented. Therefore, faulty use of the chemical of the container can be prevented, and thus the chemical can be always applied to a desired place.

What is claimed is:

1. A coupler for discharging a chemical outside a container, through an internal coupler unit coupled to a chemical outlet port of the container and then through an external coupler unit coupled to the internal coupler unit, wherein the external coupler unit comprises:

a main housing comprising a cylindrical body having a hollow space therein, with upper and lower coupling seats respectively formed in upper and lower ends of the main housing and having respective internal threads therein, and a side hole formed through a sidewall of the main housing and communicating with the hollow space of the main housing;

a hollow rod member inserted into the hollow space of the main housing and having a structure such that a lower end of the hollow rod member protrudes from a lower end of the main housing and an upper end of the hollow rod member engages with the upper coupling seat of the main housing, with an internal thread formed on a circumferential inner surface of the upper end of the hollow rod member;

a hollow cylindrical member having on a circumferential outer surface of an upper end thereof an external thread to be tightened into the lower coupling seat of the main housing, with a stopper protruding outwards from a lower end of the hollow cylindrical member;

a subsidiary housing fitted over the hollow cylindrical member and stopped by the stopper of the hollow cylindrical member, with an external thread formed on a circumferential outer surface of a lower end of the subsidiary housing to couple the subsidiary housing to the internal coupler unit;

a fluid opening control unit provided in the lower end of the hollow rod member and having a spring and a valve, which are coupled to each other and are respectively supported at upper and lower predetermined positions in the lower end of the hollow rod member;

a pumping means connector coupled to the upper end of the hollow rod member to connect the external coupler unit to a pumping means for pumping the chemical outside the container;

a gas injection means connector tightened into the side hole of the main housing to connect the external coupler unit to a gas injection means for injecting gas into the container; and a plurality of sealing caps to close respective openings of the pumping means connector and the gas injection means connector when the pumping means connector and the gas injection means connector are not in use.

2. The coupler for discharging the chemical as set forth in claim 1, wherein the internal coupler unit comprises:

a mounting part, having an external thread for coupling the internal coupler unit to the chemical outlet port of the container, and an internal thread for coupling the internal coupler unit to the external coupler unit; and a coupling pipe communicating with the mounting part and extending downwards from the mounting part, the coupling pipe being dipped into the chemical in the container when the internal coupler unit is coupled to the container, wherein a compressing protrusion is provided on a central portion of the mounting part and communicates with the coupling pipe, and a gas injection hole is formed through a bottom of the mounting part.

3. The coupler for discharging the chemical as set forth in claim 1, wherein a linear cross-sectional part is longitudinally formed on a circumferential outer surface of the hollow rod member to facilitate injection of gas into the container.

4. The coupler for discharging the chemical as set forth in claim 1, wherein the external coupler unit further comprises a faulty coupling prevention member, which is fitted over the circumferential outer surface of the subsidiary housing and has a plurality of faulty coupling prevention protrusions under a lower surface thereof, and a plurality of faulty coupling prevention holes are formed on a perimeter of an upper surface of the internal coupler unit, thus preventing faulty coupling of the external coupler unit to the internal coupler unit.

5. The coupler for discharging the chemical as set forth in claim 4, wherein the faulty coupling prevention holes of the internal coupler unit are open, a thread is formed on a circumferential inner surface of each of the faulty coupling prevention holes, and an adjustable bolt is selectively tightened into each of the faulty coupling prevention holes to selectively close some of the faulty coupling prevention holes.

6. The coupler for discharging the chemical as set forth in claim 4, wherein the faulty coupling prevention holes of the internal coupler unit are open, and an insert member is selectively fitted into each of the faulty coupling prevention holes to selectively close some of the faulty coupling prevention holes.

* * * * *